United States Patent [19]

Pacione

[11] Patent Number: 5,042,221

[45] Date of Patent: Aug. 27, 1991

[54] APPARATUS FOR APPLYING WALL COVERING AND WALL COVERING

[75] Inventor: Joseph R. Pacione, Thornhill, Canada

[73] Assignee: Tac-Fast Systems SA, Fribourg, Switzerland

[21] Appl. No.: 329,713

[22] Filed: Mar. 28, 1989

[51] Int. Cl.[5] ..... E04D 15/00

[52] U.S. Cl. ..... 52/749; 52/222; 52/DIG. 13; 156/574; 156/575

[58] Field of Search ..... 52/749, 522, DIG. 13; 156/574, 575, 577, 71; 118/261, 235, 246

[56] References Cited

U.S. PATENT DOCUMENTS

| | | | |
|---|---|---|---|
| 439,789 | 11/1890 | McQueney | 156/574 |
| 621,595 | 3/1899 | Beal | 156/575 |
| 696,672 | 4/1902 | Glickman | 156/575 |
| 708,124 | 9/1902 | Cannon | 156/575 |
| 739,393 | 9/1903 | Crockett | 156/575 |
| 803,270 | 10/1905 | Butler | 156/574 |
| 1,274,040 | 7/1918 | Hitchcock | 156/575 |
| 2,291,691 | 8/1942 | Caufman | 156/575 |
| 3,625,798 | 12/1971 | Ihli | 156/574 |
| 3,991,842 | 11/1976 | Larsen | 156/574 |
| 4,714,509 | 12/1981 | Gruber | 156/574 |

*Primary Examiner*—Henry E. Raduaro
*Attorney, Agent, or Firm*—Brian W. Gray

[57] ABSTRACT

A wall covering is provided for a wall board system, in which the wall board bears one half of a hook and loop fastening system. The wall covering bears the complementary half of the fastening system on one side and has a decorative finish on the other. An apparatus for applying the wall covering in roll form, by unrolling the wall covering under tension and providing spaces for the attachment of trim pieces on the edges of the wall board is also described, as well as a method for applying the wall covering.

6 Claims, 2 Drawing Sheets

APPARATUS FOR APPLYING WALL COVERING AND WALL COVERING

FIELD OF THE INVENTION

This invention relates a flexible wall covering, having on its back surface one half of a hook and loop fastening system, and to an apparatus to apply this wall covering to a wall having the complementary half of the fastening system.

BACKGROUND OF THE INVENTION

Co-pending U.S. patent application No. 148,711 filed Jan. 26, 1988 relates to a wall board bearing one half of a hook and loop fastening system, such as the VELCRO fastening system. The wallboard, as disclosed in that application, is designed to accept wall coverings, panelling and trim pieces which bear on their back surface, the complementary part of the fastening system.

One of the wall coverings which would be desirable to apply to the wallboard surface is a flexible wall covering, such as wallpaper or fabric. These are especially desirable because of the difficulty in painting the wall board. These wall coverings have a decorative finish on one side, and may be made in layers. For instance, fabric, vinyl or paper may be laminated to a support layer such as a fabric web.

In order to be attached to the wallboard, the wall covering should bear one half of a hook and loop fastening system on its back face, complementary to the half on the wallboard.

Materials bearing loops on one side are known, and are designed to be laminated to or stretched over rigid surfaces with the loops facing outward. Thus, these materials do not have a decorative finish on the side opposite the side with the loops, and they are not designed for use as wall coverings with the loops attached to the wall surface.

Difficulties may be encountered in applying a flexible wall covering to the wall surface in that the covering tends to bunch and wrinkle. The appearance of wall coverings is important, and a wrinkled wallpaper would not usually be acceptable. It is also desirable to apply wall coverings in widths that are as wide as practicable, to lessen the labour and skill involved in matching seams and patterns of adjoining widths. Mechanization of the application steps would further reduce labour requirements.

Most construction does not provide perfectly square or plumb walls; some adjustment is therefore necessary when applying wall coverings, especially if wide sheets are used. In addition, trim pieces may be attached to these wall surfaces, and so it may be desirable to provide a calibrated space not covered by the flexible wall covering on the wall in order to permit the attachment of trim pieces.

Finally it is especially advantageous to apply wall coverings horizontally and not vertically since the seams may be less prominent and a full run along a wall may be achieved.

BRIEF SUMMARY OF THE INVENTION

This invention provides a two-sided flexible wall covering having a decorative finish on one side and one half of a hook-loop fastening system on the other side, adapted to cover a rigid surface bearing the complementary half of the fastening system. Preferably, the half on the wall covering will be the loop. The wall covering may be produced in roll form for ease of installation.

This invention also provides an apparatus for laying a flexible wall covering having on at least one side one half of a hook-loop fastening system, to a surface including the complementary half of a hook-loop fastening system, comprising a support for a supply roll of flexible wall covering material, an applicator bar for applying the wall covering to the surface and a tensioning means for maintaining a desired tension on the supply roll of wallpaper during the application step.

In particular embodiments of the apparatus of the invention, it also includes means to adjust the supply roll support to a chosen height or a chosen position, so that appropriate spaces are left for the addition of trim pieces to the surface, and to provide for out of plumb surfaces.

The applicator bar may be oriented vertically for applying the covering to a wall surface or horizontally for the application of the covering to a ceiling surface.

This invention also provides a method of installing the wall covering of the invention.

THE DRAWINGS

DETAILED DESCRIPTION OF THE EMBODIMENTS SHOWN

Figure 1:
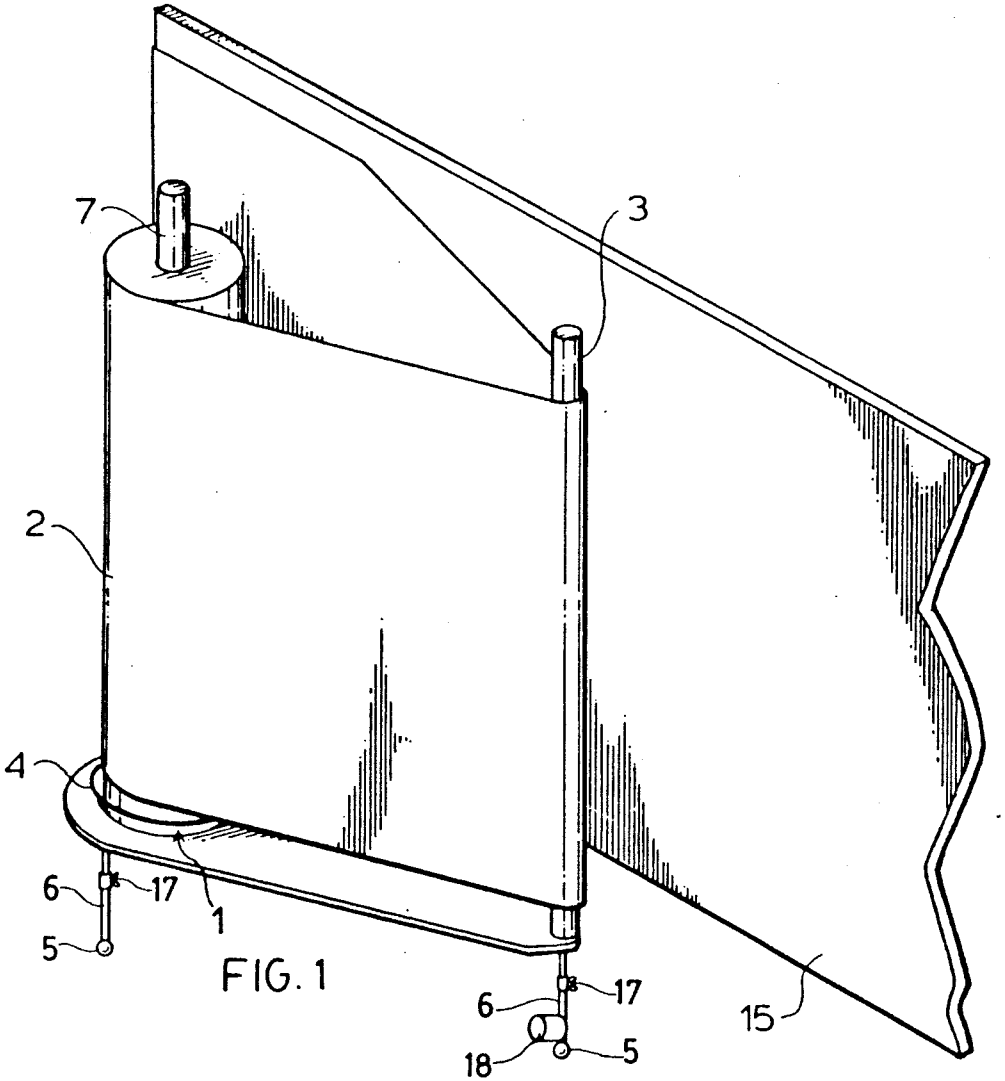
FIG. 1 shows an embodiment of the apparatus of this invention.

One embodiment of the invention can be seen in FIG. 1, and comprises a rotating supply roll support 1 for the holding the supply roll of a flexible wall covering 2. The wall covering 2 is fed from the supply roll to the applicator bar 3, under tension. The tension is provided by a brake 4 on the supply roll support 1. Tensioning means is provided by the brake 4, shown as a band which may be loosened or tightened to decrease or increase the resistance to rotation of the supply roll support 1. The entire apparatus is mounted on wheels 5, on adjustable legs 6 the height of which may be adjusted by leg height adjusters 17 providing adjustment means for positioning the support of this embodiment, i.e., spindle height with respect to a wall. The leading wheel is powered by electrical motor 18.

The supply roll support has a spindle 7 on which the wall covering can be loaded.

Figure 2:
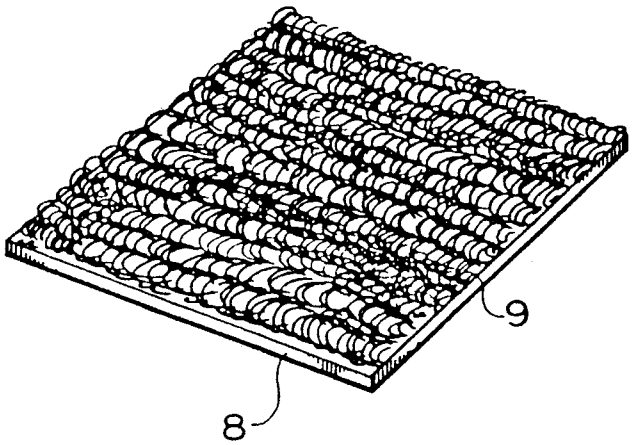
FIG. 2 shows an embodiment of the wall covering of this invention.

The wall covering can be seen in FIG. 2, and consists of a flexible layer 8, for instance, fabric, paper or plastic, which has a decorative finish, on a fabric web backing 9 with loops provided in the fabric backing 9. The loops are thus integral with the backing. In the wall covering shown, the loops cover substantially all of the back surface of the wall covering. The decorative finish may be printed or applied to the wall covering or may be provided by the texture and colour of the covering.

Figure 3:
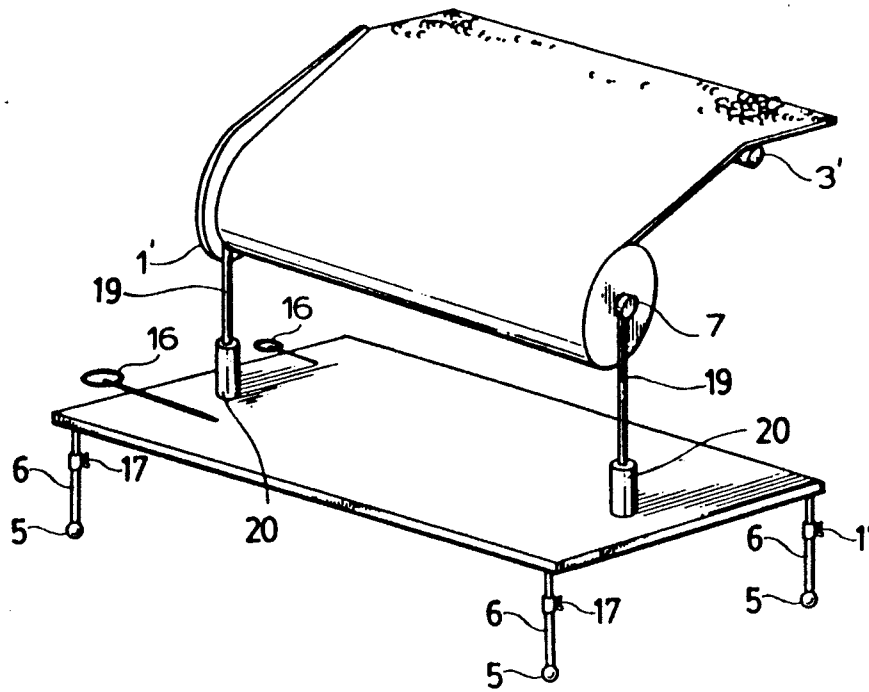
FIG. 3 shows another embodiment of the apparatus, adapted to be sued for ceiling coverings.

FIG. 3 shows a variant of the apparatus shown in FIG. 1, adapted for applying a flexible wall covering to a ceiling. The rotating supply roll support 1' is positioned horizontally rather than vertically, as is the applicator bar 3'. In FIG. 3, the brake is not shown. Spindle 7 is mounted on legs 19 having leg height adjusters 20 providing height adjustment means for setting the height of the support of this variant. Further height adjustment means may be provided by adjusters 17 for legs 6.

Figure 4:
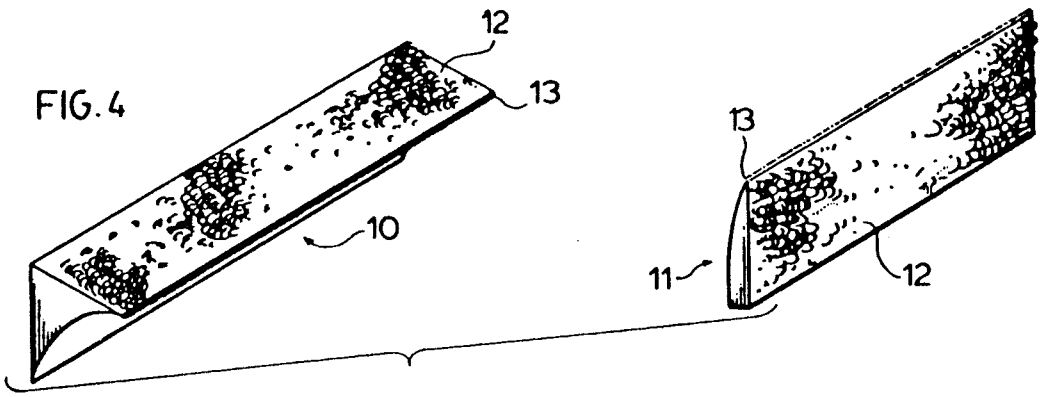
FIG. 4 shows sample trim pieces.

FIG. 4 shows edge covering finishing units—trim pieces of various configurations for use together with the flexible wall covering described. Item 10 is cover molding, and 11 is a baseboard. It will be seen that 10 and 11 have loops on their back surface 12. They also have flexible, thin edges 13.

USE OF THE EMBODIMENTS SHOWN

In the use of the apparatus shown in FIG. 1, the wall covering 2 is loaded on to the spindle by rolling it around the spindle 14. The loaded spindle is part of the supply roll support. The wall covering is then fed around the applicator bar 3, and the brake 4 adjusted to provide proper tension.

The loop surface of the wall covering should be in a position to engage with the hook surface 15 of the building wall or ceiling (not shown) as it passes around the applicator bar. The bar then acts as a means to engage the loop surface to the hook surface.

The free end of the wall covering is engaged with the wall and the apparatus is rolled along the wall on wheels 5. The brake 4 acts as a tensioning means, and is adjusted to provide adequate tension to the wall covering so that wrinkling and bunching of the wall covering is minimized.

When a door or window opening is encountered, the apparatus simply lays the walls covering over the opening and the doorway or window may be cut out of the wall covering later. The height of the supply roll is adjusted by raising or lowering the roll support by adjustment of the legs 6, in order to provide a space of adequate size so that the baseboard 11 can be applied to the wall at the bottom of the wall covering and the cove molding 10 can be applied at the corner of the ceiling and the wall.

The apparatus for ceiling application can be used in an analogous manner. The distance form one wall is established by adjustment means for positioning the support provided by a gauge 16, in order to leave an adequate space for the cove molding 10. The covering can be applied along two walls of a square room; the centre of the ceiling then covered, and any overlap trimmed. Thus, predetermined spaces will be left for the installation of cove molding or other decorative trim pieces. Because the loops cover substantially all of the back of the wall covering, there is no difficulty in trimming the wall covering at any place or along any particular line. The structure of the wall covering shown, with the loops part of the fabric backing, provides strength to the wall covering so that it may be stripped from the wall if desired.

The flexible edges 13 of the trim pieces are adapted to fit against the wall covering with a minimal gap between the edge and the wall covering. Wiring (such as telephone wiring) may be run through a channel in the baseboard.

VARIATIONS

Many variations are possible to the embodiments shown.

The wall covering may have a finish which is printed, embossed, woven, engraved or textured onto or in to the surface.

The apparatus may be powered by an electrical motor, and may be made in various sizes to accommodate wall covering of various widths, to suit 8 foot or 9 foot high walls, for instance. Different means of adjusting tension and height may be used. The applicator bar may be replaced by a roller, and this may be desirable to reduce the chance of damaging more fragile wall coverings. The applicator bar may need to be curved slightly to tension the wall covering evenly across its width.

I claim:

1. An apparatus for applying a flexible covering, bearing on at least one surface one half of a hook-loop fastening system, to a rigid surface of a building bearing the complementary half of a hook-loop fastening system, comprising:

(a) a movable support for a roll of the wall covering;

(b) adjustment means for positioning the support to provide for a space between at least one edge of the roll and at least one edge of the rigid surface to attach edge covering finish units;

(c) an applicator means for engaging the half of the hook-loop system on the wall covering to the half of the hook-loop system on the wall covering to the half of the hook-loop system on the rigid surface; and (d) tensioning means for maintaining the desired tension on the wall covering as it is applied to the rigid surface.

2. The apparatus of claim 1 wherein the movable support further comprises a rotatable spindle for engagement of the roll thereon.

3. The apparatus of claim 2 wherein the movable support further comprises a base having supporting wheels wherein the wheels are electrically powered.

4. The apparatus of claim 2 for use with a wall surface of a building wherein the spindle is generally upright and the adjustment means comprises height adjustment means for the spindle.

5. The apparatus of claim 2 for use with a horizontal surface wherein the adjustment means comprises a gauge.

6. The apparatus of claim 2 wherein the tensioning means is an adjustable brake operably connected to the spindle.

* * * * *